US006433656B1

(12) United States Patent
Wolk et al.

(10) Patent No.: US 6,433,656 B1
(45) **Date of Patent: *Aug. 13, 2002**

(54) FREQUENCY-STABILIZED WAVEGUIDE ARRANGEMENT

(75) Inventors: Dieter Wolk, Winterbach; Juergen Damaschke, Heilbronn; Dietmar Schmitt, Allmersbach I. t., all of (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/430,272

(22) Filed: Oct. 29, 1999

(30) Foreign Application Priority Data

Dec. 21, 1998 (DE) ..... 198 59 028

(51) Int. Cl.[7] ..... H01P 7/06; H01P 1/30
(52) U.S. Cl. ..... 333/248; 333/208; 333/229
(58) Field of Search ..... 333/248, 255, 333/229, 208, 209

(56) References Cited

U.S. PATENT DOCUMENTS

| | | | | | |
|---|---|---|---|---|---|
| 2,465,719 | A | * | 3/1949 | Fernsler | 333/248 |
| 3,140,342 | A | * | 7/1964 | Ehrreich et al. | 174/35 GC |
| 4,158,825 | A | | 6/1979 | Guenther et al. | |
| 4,288,105 | A | * | 9/1981 | Press | 285/55 |
| 4,654,612 | A | | 3/1987 | Smith | |
| 4,677,403 | A | * | 6/1987 | Kich | 333/229 |
| 4,932,673 | A | * | 6/1990 | Domnikov et al. | 277/608 |
| 5,179,363 | A | | 1/1993 | Schwarz et al. | |
| 5,341,116 | A | | 8/1994 | Kerkhoff et al. | |
| 5,374,911 | A | * | 12/1994 | Kich et al. | 333/209 |
| 5,867,077 | A | * | 2/1999 | Lundquist | 333/208 |
| 6,002,310 | A | * | 12/1999 | Kich et al. | 333/208 |

FOREIGN PATENT DOCUMENTS

| | | | |
|---|---|---|---|
| EP | 0 477 567 A2 | 4/1992 | |
| EP | 0 621 651 B1 | 7/1998 | H01P/1/208 |
| WO | WO 87/03745 | 6/1987 | H01P/7/06 |

* cited by examiner

*Primary Examiner*—Robert Pascal
*Assistant Examiner*—Dean Takaoka
(74) *Attorney, Agent, or Firm*—Michael J. Striker

(57) ABSTRACT

A waveguide arrangement for microwaves and the like has a first waveguide composed of a material having a first thermal expansion coefficient, a second waveguide composed of a material having a second thermal expansion coefficient which is different from the first thermal expansion coefficient, and a transition element provided between the first and second waveguides for mechanical uncoupling of the different thermal expansion coefficients of both the waveguides.

22 Claims, 5 Drawing Sheets

FREQUENCY-STABILIZED WAVEGUIDE ARRANGEMENT

BACKGROUND OF THE INVENTION

The present invention relates to a frequency stabilized waveguide arrangement for microwaves and the like.

Waveguides and cavity resonators which are formed as waveguides with reflecting end walls or screens are frequently used in microwave technology, for example as filters. The resonance frequency of such cavity resonators depends on the dimensions, in particular the axial length of the resonator. Since the waveguide material thermally expands with raising temperatures, the resonance frequency of a resonator reduces with increasing temperature. A temperature increase on the other hand can not be avoided with high power components due to the energy dissipation.

It is known to produce waveguides of a material with low temperature expansion coefficients, such as Invar or Superinvar. Invar has a thermal expansion coefficient of approximately 1.5 ppm/K. This material however has the disadvantage that the thermal conductivity is poor and dissipated heat can be withdrawn only insufficiently, so that the waveguide arrangement is further heated. Aluminum is preferable as a material with high thermal conductivity and in addition low weight, in particular for environmental uses. However, on the other hand it has a high temperature expansion coefficient in the region of 22–24 ppm/K.

International published patent application WO 87/03745 and European patent EP 0 621 651 B1 disclose temperature-compensated cavity resonators which have curved screens facing toward the interior of the resonator and having a curvature which increases with increasing temperature. Thereby a temperature-dependent longitudinal expansion of the cavity resonator is compensated. The curved screens, for example end walls, are however expensive and costly in production, and must be individually dimensioned with regard to the frequency conditions.

When for example a filter composed of several cylindrical Invar resonators is held by aluminum mounting elements, the thermally dependent deformations occur at the contact points of the different materials. When an aluminum mounting element, for example engages an Invar flange of the resonator, a temperature-dependent bending of the resonator screen and thereby an additional undesirable frequency shift occurs.

A similar problem arises when a waveguide of Invar is coupled with a further waveguide of another material such as aluminum, which has a higher thermal expansion coefficient. In this case, due to the different thermal expansion coefficients of the materials, the both coupled waveguides are subjected to thermally-dependent deformations which lead to a frequency shift.

SUMMARY OF THE INVENTION

Accordingly, it is an object of the present invention to provide a frequency-stabilized waveguide arrangement, which avoids the disadvantages of the prior art.

In keeping with these objects and with others which will become apparent hereinafter, one feature of the present invention resides, briefly stated, in a waveguide arrangement which has a first waveguide composed of a material with a first thermal expansion coefficient, a second waveguide composed of a material with a second thermal expansion coefficient, and a transition element provided between the first waveguide and the second waveguide for mechanical uncoupling of the different thermal expansion coefficients of the both waveguides.

The inventive waveguide arrangement has the disadvantage that despite different materials of the both waveguides, a thermally-dependent deformation and frequency shift is minimized. At least one of the both waveguides can be a resonator with end walls, for example screens. Due to the transition element, a deformation of the end walls or screens is also minimized.

A transition element can be for example a circular, outwardly open gap. This permits a bending at the border surface of the two waveguides.

The transition element can be provided with milled depression which allows a deformation of the screen mounted on it or adjoining it, in both directions.

In accordance with another embodiment of the invention, the waveguide arrangement has a mounting element applied on a flange of the waveguide. It has a material with a different thermal expansion coefficient than the waveguides, or its screens and associated flanges. On the flange or the end wall/screen, a compensation element can be provided for compensation of thermal deformation of the end wall which is caused by different thermal expansion coefficients. Preferably, the mounting element can be composed of aluminum and the compensation element can be composed of Invar.

This inventive waveguide arrangement has the advantage that, for mechanical holding of the waveguide arrangement and for withdrawing of heat, the mounting elements of a material such as aluminum can be used, which has a high thermal conductivity, but also a high thermal expansion coefficient, without causing an additional thermal-dependent frequency detuning.

The inventive waveguide arrangement in accordance with another embodiment has a ring-shaped compensation for compensation of thermal deformation of the waveguide, and the compensation means have a different thermal expansion coefficient than the waveguides. The compensation means can have a higher thermal expansion coefficient than the waveguides, so that with increasing temperature for compensation an axial expansion of the resonator, the end wall or the screen of the waveguide is deformed inwardly. Therefore a thermal expansion of the waveguide can be compensated.

The end wall or the screen of the waveguide arrangement can be for example flat at ambient temperature. When compared with an initial condition at ambient temperature of curved end walls or screens, there is a disadvantage of an easier and therefore less expensive manufacture.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
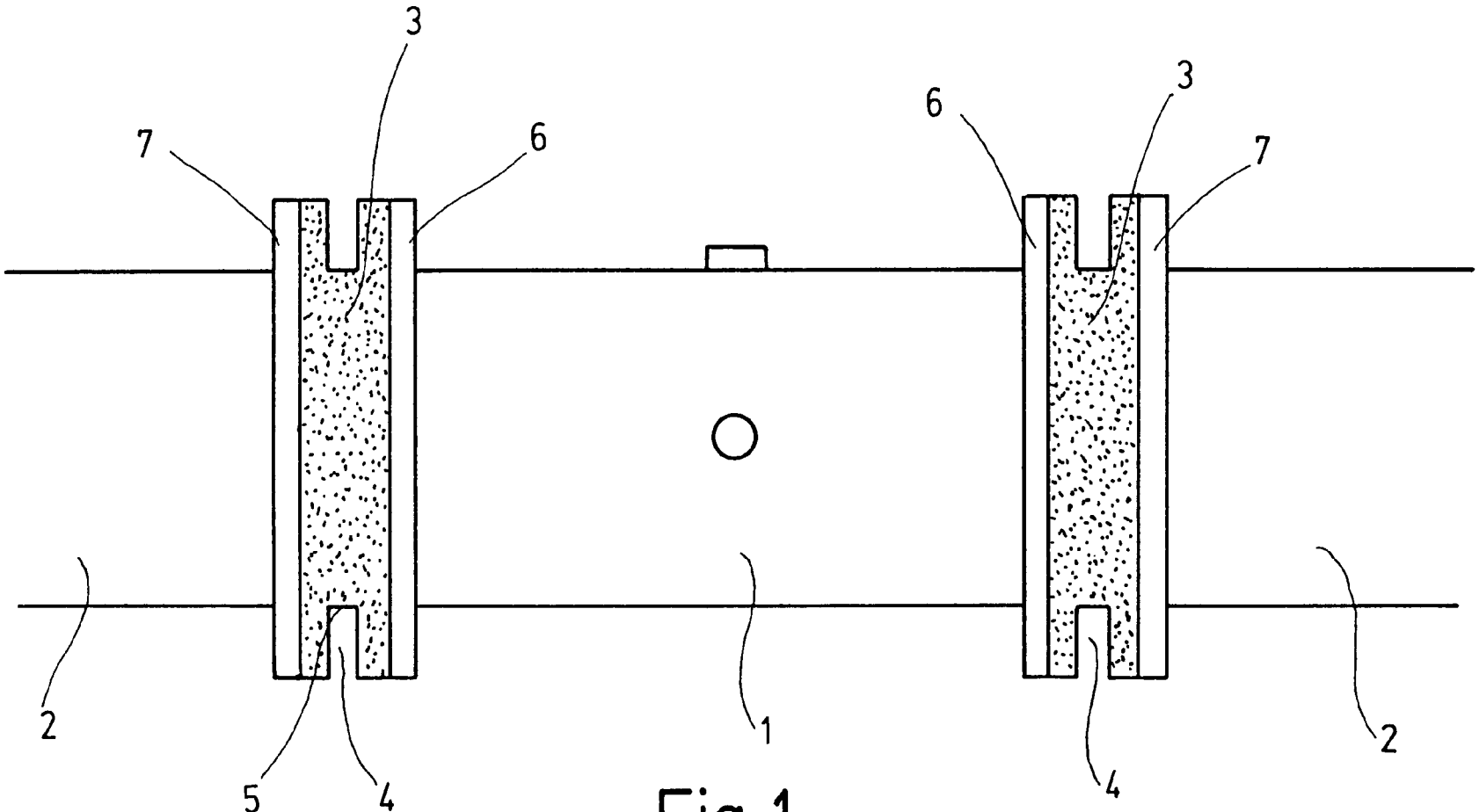
FIG. 1 is a view showing a first embodiment of a waveguide arrangement in accordance with the present invention.

FIG. 1 shows a first embodiment of an inventive waveguide arrangement. A first waveguide 1 is formed as a cavity resonator. It has an axis-symmetrical, for example cylindrical resonator body with a flange 6 mounted on its end sides. Further waveguides 2 are arranged at both sides of the cavity resonator 1. They operate for coupling or uncoupling of electromagnetic waves, for example microwaves from the resonator 1.

The invention is of course not limited to this specific arrangement. It can be used in any arrangement of several waveguides, or resonators coupled with one another.

The waveguide 1 and the waveguide 2 are composed of a material with different thermal expansion coefficients. A transition element 3 is arranged between them. It can be arranged for example on an input screen or an output screen, which are not shown in the drawings. The transition element 3 has a circular, outwardly open gap 4. The gap base approximately corresponds to the outer dimensions of the waveguide. Due to the gap 4, thermally-dependent deformations at the transition region of the waveguides 1 and 2 with different thermal expansion coefficients can be absorbed.

The first waveguide 1 formed as a resonator, and also the transition element 3 can be composed of Invar, while the waveguide 2 can be composed of aluminum with a thermal expansion coefficient which is higher by the factor 15. Aluminum has however, as explained above, the advantage with regard to weight and thermal conductivity. In the transition region between the flange 7 and the transition element 3, a deformation occurs with increasing temperature, or a so-called bimetal effect. Because of the gap 4 of the transition element 3, it remains however limited at the side of the transition element 3 facing the flange 7. The not shown screen of the resonator 1 is arranged on the other side of the transition element 3 and therefore mechanically uncoupled from the temperature-dependent deformation.

Figure 5:
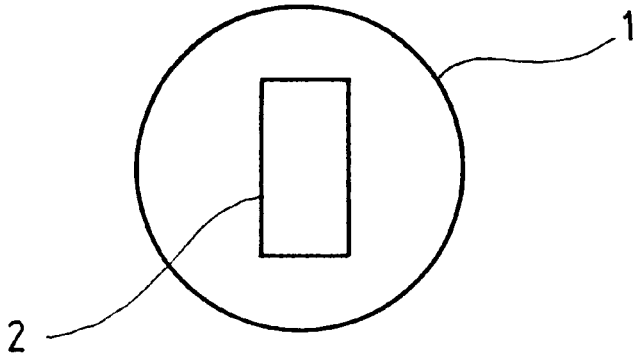
FIG. 5 is a view showing a transition between waveguides with different cross-sections.

FIG. 5 shows, schematically for illustration purposes the transition between the waveguides 1, 2 with different cross-sections. The waveguide 1 has a cylindrical cross-section and the waveguide 2 has a rectangular cross-section. In this arrangement also the inventive transition element 3 can be provided.

Figure 6:
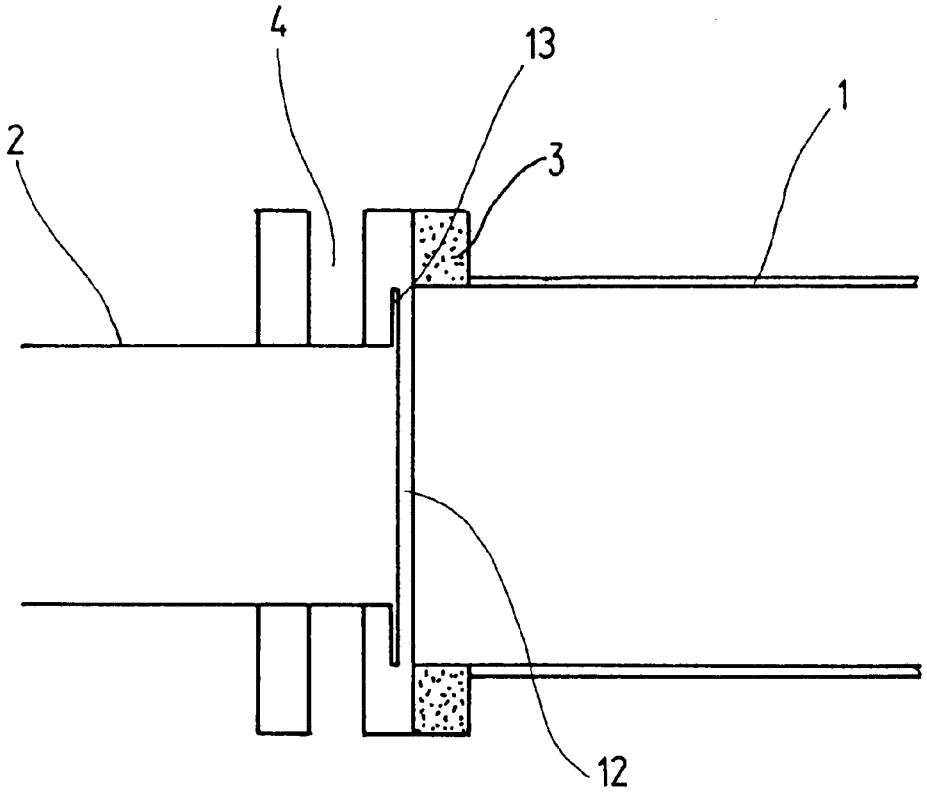
FIG. 6 is a view showing a fourth embodiment of an inventive waveguide arrangement.

FIG. 6 shows a further embodiment of the inventive waveguide arrangement. The transition element 3 is arranged between the waveguide 1 formed as a resonator and the second waveguide 2, and a screen 12 is mounted on the transition element. The gap 4 serves for a mechanical uncoupling of the mechanical deformation which is caused by the different thermal expansion coefficients. Furthermore, a circumferential milled-out depression 13 is provided near the screen 12. It allows a deformation of the screen in both directions. This variant is especially advantageous for a transition between waveguides with different cross-sections as shown for example in FIG. 4. In the event of use of a material with high thermal expansion coefficient, it is possible that the free deformation of the circular screen at the transition to the rectangular waveguide is hindered. This hindering can however be avoided by the milled-out depression 13.

Figure 2:
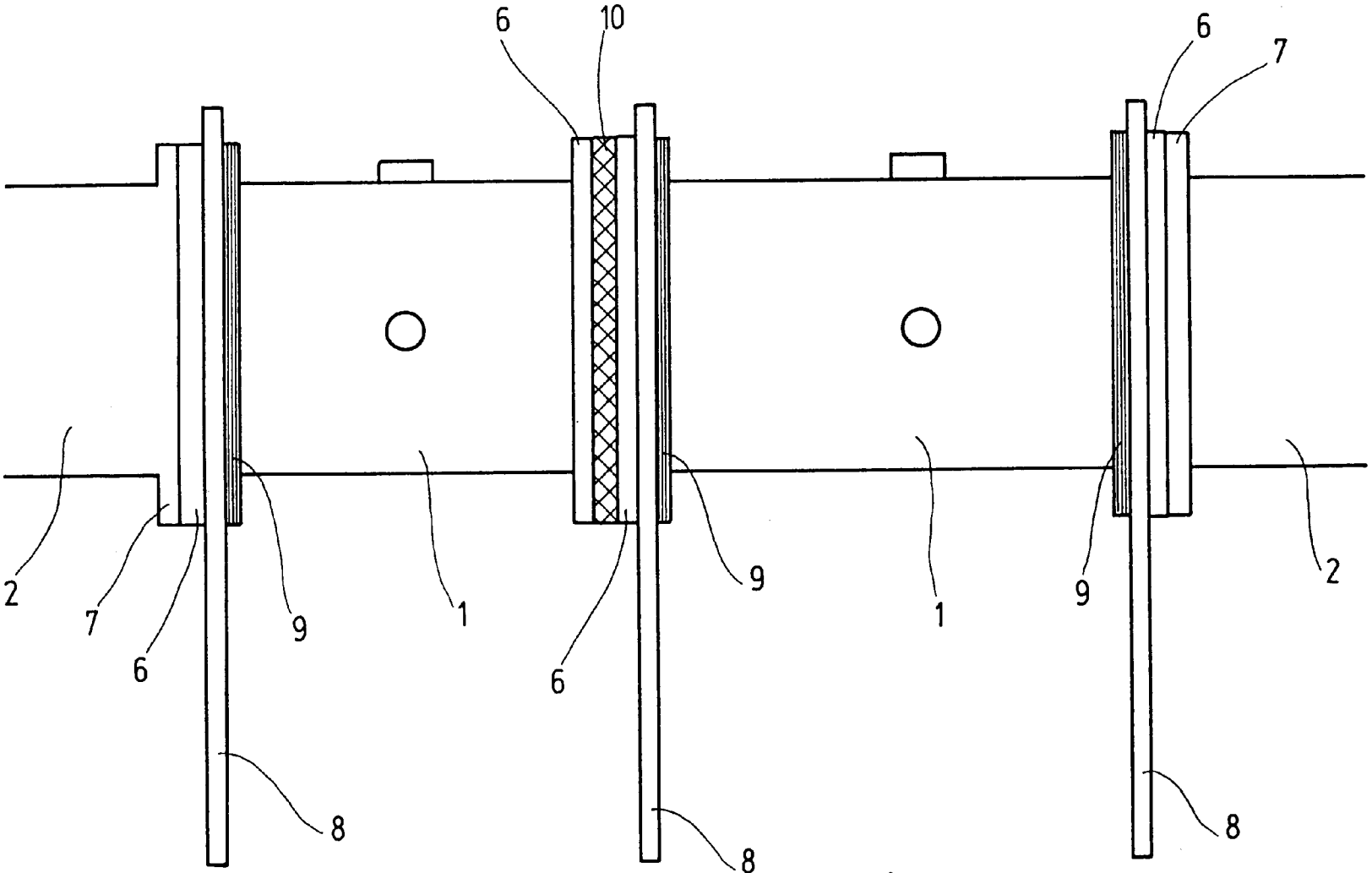
FIG. 2 is a view showing a second embodiment of a waveguide arrangement in accordance with the present invention.

FIG. 2 shows a second embodiment of the inventive waveguide arrangement. In this embodiment two waveguides 1 are arranged axially one behind the other and connected by a coupling screen 10. Such a multi-resonator arrangement is used for example as a filter. For coupling and uncoupling, further waveguides 2 are provided. Moreover, the present invention is not limited to the above mentioned arrangement of the components. It can be adjusted to any use by a person skilled in the art.

For mechanical mounting and for withdrawal of heat, mounting elements 8 are provided in the inventive arrangement. They are mounted on the flange 6 of the waveguides. The mounting elements 8 are composed for example of a material with high mechanical stability and good thermal conductivity, such as aluminum. Another material can be however also used depending on the application of the arrangement. For compensation of thermal deformations due to different thermal expansion coefficients of the mounting element 8 and the waveguides 1, 2, which on the one hand can lead to a bending of the coupling screen 10 or to coupling or uncoupling at the transitions between the waveguides 1 and 2, ring-shaped compensation elements 9 are mounted on the mounting elements 8. The compensation elements can be composed of a material which have a lower thermal expansion coefficient than the material of the mounting elements 8. The reversed situation is however also possible. The compensation element has a higher thermal expansion coefficient than the corresponding mounting element. In this case the compensation element is however arranged on the corresponding opposite flange side. With suitable arrangement, material selection and thickness of the compensation element 9, a thermally dependent deformation can be compensated almost completely by the mounting element 8.

Figure 3:
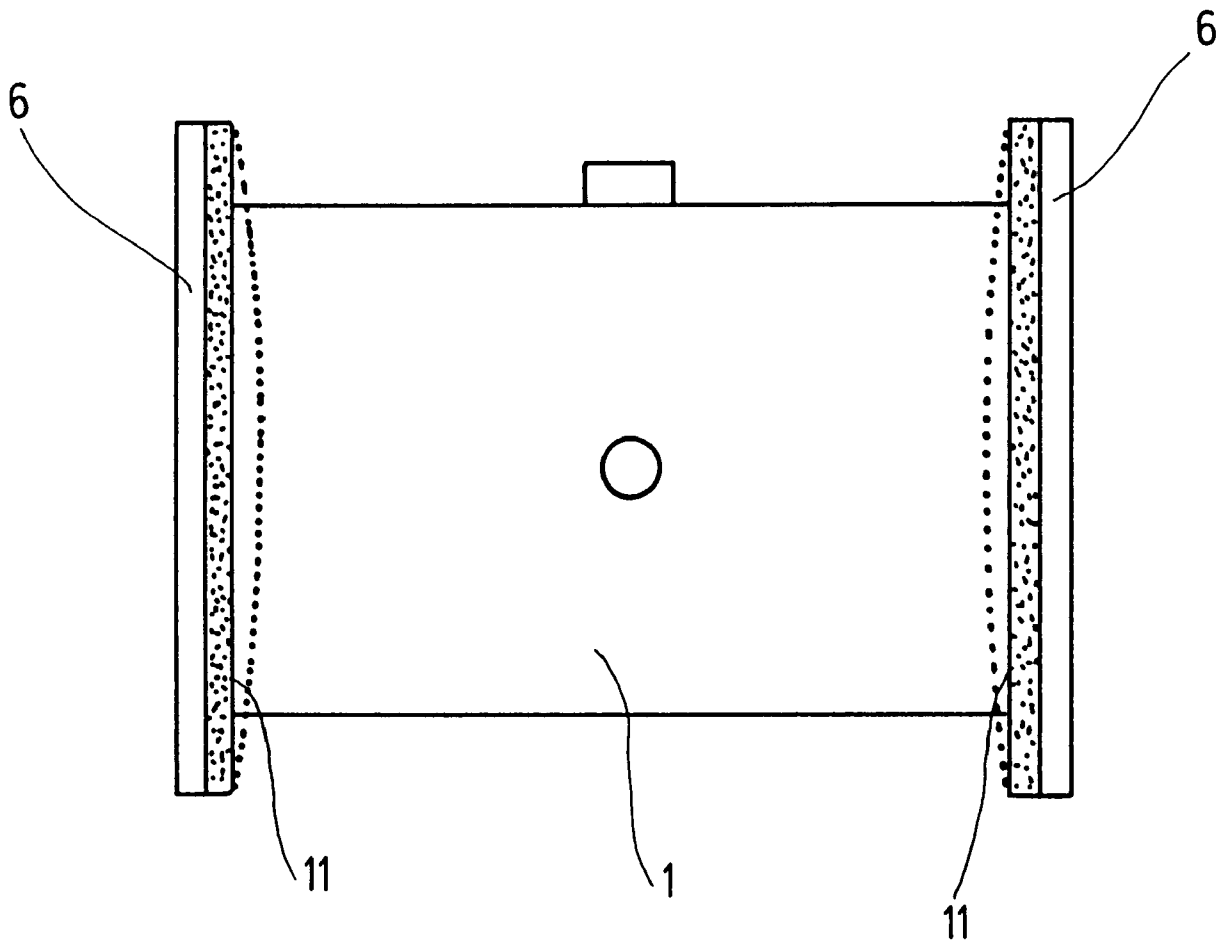
FIG. 3 is a view showing a third embodiment of a waveguide arrangement in accordance with the present invention.

FIG. 3 shows a third embodiment of the inventive waveguide arrangement. The waveguide 1 has an axis-symmetrical, for example cylindrical waveguide body, and flanges 6 arranged at both sides. Not shown end walls or screens are arranged at both end sides. Compensation elements are mounted on the flanges 6 toward the resonator center. They are composed of a material with a higher thermal expansion coefficient than the resonator body 1 and the flange 6. For example the waveguide can be composed of Invar and the compensation means 11 can be composed of aluminum. Also, an opposite situation is possible. The compensation means 11 can be composed of a material with a lower thermal expansion coefficient than the waveguide 1 and are arranged in this case at the opposite side of the flanges 6.

The compensation means 11 can be formed for example as a compensation ring. It can be mounted on a side of the waveguide or, as shown, on both sides of the same. Due to the different thermal expansion coefficients of the compensation ring 11 and the flange 6, a heating of the waveguide arrangement leads to a thermal deformation which causes a buckling of a screen mounted on the flange 5 toward the resonator center, as shown schematically by a broken line in FIG. 3. Due to this deformation, the effective length of the central axis of the waveguide 1 which is decisive for the resonator frequency is smaller. Thereby the thermal expansion of the waveguide is compensated. With suitable selection of the thickness of the material of the compensation ring 11, a desired temperature-dependent frequency characteristics of the resonator 1 can be adjusted. The screen in a normal temperature region is preferably flat, so that it can be produced by punching in a simple and price favorable manner. A temperature compensation of the waveguide provided by this compensation ring can be performed simply from outside, without introducing a tuning pin or similar element into the interior of the waveguide.

Figure 4:
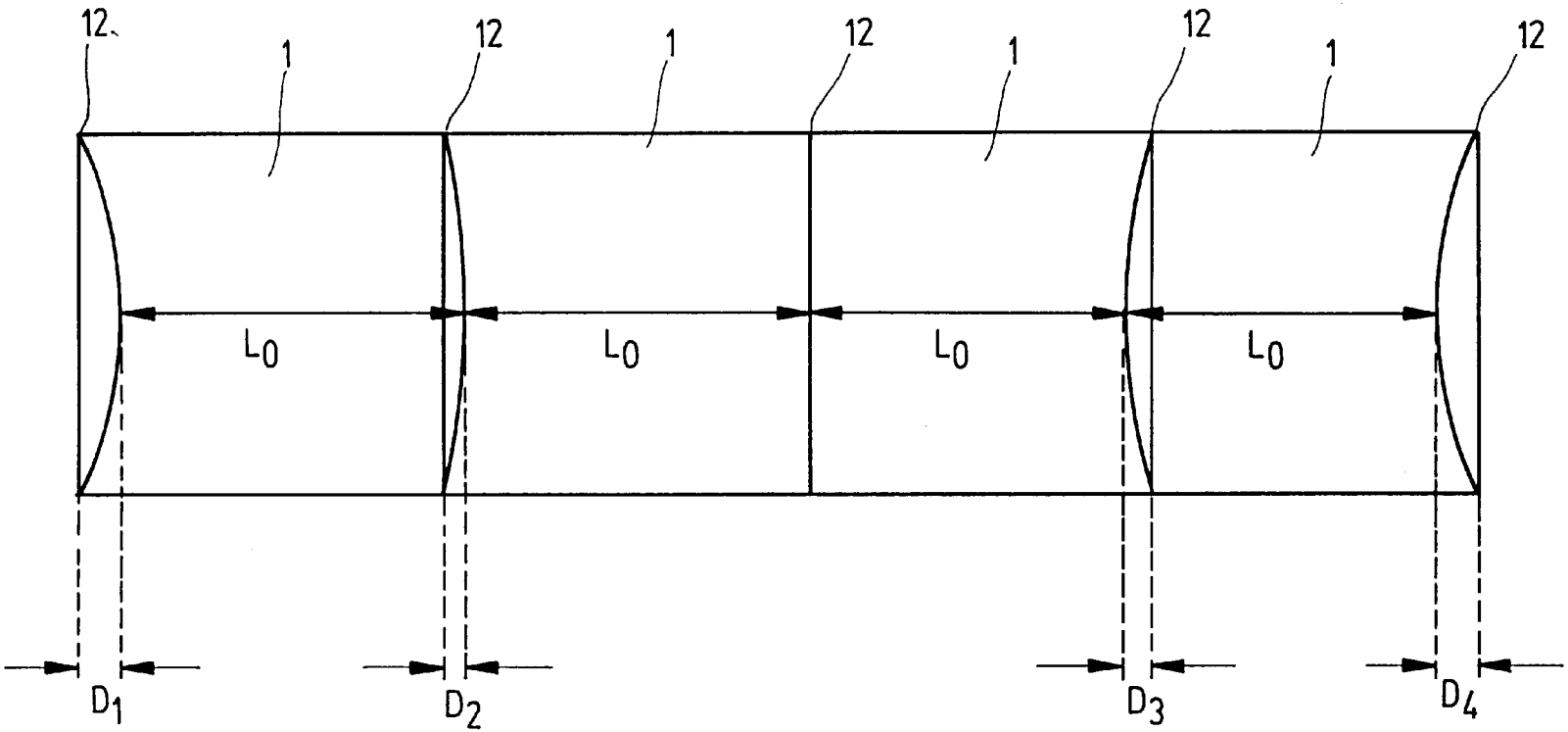
FIG. 4 is a view schematically showing an exemplary multi-resonator arrangement of the invention.

FIG. 4 schematically shows a multi-resonator arrangement with four resonators 1. It is limited each by the screens 12, which have compensating means. With an ambient temperature, they cause a deformation to the central axis of the corresponding resonator of $D_1$, $D_2$, $D_3$, or $D_4$. In this example it is selected to provide the following ratio $D_1=D_4=2D_2=2D_3$. Therefore al four resonators 1 of the multi-resonator arrangement provide a uniformly strong compensation, and their lengths $L_0$ each correspond to the length in a normal temperature region.

It should be of course mentioned that the invention is not limited to the specific shown embodiments. In particular, the different aspects illustrated in the specific embodiments can be combined with one another. A waveguide arrangement of the invention can have for example transition elements 3, mounting elements 8, compensation elements 9, as well as additional compensation rings 11 provided with a gap.

It will be understood that each of the elements described above, or two or more together, may also find a useful application in other types of constructions differing from the types described above.

While the invention has been illustrated and described as embodied in frequency-stabilized waveguide arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claim is:

1. A waveguide arrangement, comprising at least one waveguide having end walls provided with flanges and composed of a material with a first thermal coefficient; at least one compensation means provided on said end walls for compensation of a thermal deformation of said waveguide, said compensation means having a second thermal expansion coefficient which is different from said first thermal expansion coefficient, wherein said second thermal expansion coefficient is greater than said first thermal expansion coefficient, said compensation means being mounted on a side of said flange which faces toward said waveguide, so that with increasing temperature for compensation of an axial expansion of a body of said waveguide, said end wall is deformed inwardly.

2. A waveguide arrangement as defined in claim 1, wherein said at least one waveguide is axis-symmetrical.

3. A waveguide arrangement as defined in claim 1, wherein said at least one waveguide is cylinder-symmetrical.

4. A waveguide arrangement as defined in claim 1, wherein at least one of said at least one waveguides is a resonator.

5. A waveguide arrangement as defined in claim 1, wherein a transition element is provided between two of said at least one waveguides for mechanical uncoupling of the different thermal expansion coefficients of both said waveguides, said transition element formed so that it can elastically take up a thermal expansion of both said waveguides.

6. A waveguide arrangement as defined in claim 1, further comprising a transition element provided between two of said at least one waveguides for mechanical uncoupling of the different thermal expansion coefficients of both said waveguides, said transition element having an outer diameter corresponding to an outer diameter of said flange.

7. A waveguide arrangement as defined in claim 1; further comprising a screen arranged between two of said at least one waveguides and a transition element provided between said two of said at least one waveguides for mechanical uncoupling of the different thermal expansion coefficients of both said waveguides, said transition element at a side facing said screen having a depression which allows a both-side deformation of said screen.

8. A waveguide arrangement as defined in claim 1, wherein said second thermal expansion coefficient is greater than said first thermal expansion coefficient, said compensation means being mounted on a side of said flange which faces toward said waveguide, so that with increasing temperature for compensation of an axial expansion of a body of said waveguide, said end wall is deformed inwardly.

9. A waveguide arrangement as defined in claim 1, wherein said end wall is flat at room temperature.

10. A waveguide arrangement as defined in claim 1, wherein said end wall is provided with an opening and formed as a screen.

11. A waveguide arrangement as defined in claim 1, wherein said waveguide and said end walls are composed of Invar, while said compensation means is composed of aluminum.

12. A waveguide arrangement as defined in claim 1, wherein a body of said waveguide and also said side walls are formed of one piece with one another.

13. A waveguide arrangement as defined in claim 1, wherein a transition element is provided between two of said at least one waveguides for mechanical uncoupling of the different thermal expansion coefficients of both said waveguides, said transition element formed as an outwardly open gap.

14. A waveguide arrangement as defined in claim 13, wherein said gap of said transition element is circular.

15. A waveguide arrangement as defined in claim 1, a transition element provided between two of said at least one waveguides for mechanical uncoupling of the different thermal expansion coefficients of both said waveguides, and further comprising at least one further such transition element, said waveguides with said transition elements forming a multi-resonator arrangement along a central axis.

16. A waveguide arrangement as defined in claim 15, wherein said multi-resonator arrangement includes a first and a last resonator, and an input and an output waveguide, said first and said last resonators being connected through a respective one of said transition elements with said input and output waveguides.

17. A waveguide arrangement as defined in claim 1, further comprising a transition element provided between two of said at least one waveguides for mechanical uncoupling of the different thermal expansion coefficients of both said waveguides and a screen arranged on said transition element.

18. A waveguide arrangement as defined in claim 17, wherein said screen is an input screen.

19. A waveguide arrangement as defined in claim 17, wherein said screen is an output screen.

20. A waveguide arrangement as defined in claim 17, wherein said transition element is composed of a material which is a material of said first waveguide, said screen being mounted on a side of said transition element which faces said first waveguide.

21. A waveguide arrangement, comprising at least one waveguide body having end walls provided at end sides and composed of a material with a first thermal expansion coefficient; a flange provided on at least one of said end walls; a mounting element arranged on said flange and composed of a material with a second thermal expansion coefficient; and a compensation element provided on an element selected from the group consisting of said flange and one of said end walls for compensation of thermal deformations of said one end wall which are caused by different thermal expansion coefficients of said end wall and said flange on the one hand and said mounting element on the other hand.

22. A waveguide arrangement as defined in claim 21, wherein said waveguide, said end wall with said flange and said compensation element are composed of Invar, while said mounting element is composed aluminum.

* * * * *